US007356295B2

(12) United States Patent
Imamura

(10) Patent No.: US 7,356,295 B2
(45) Date of Patent: Apr. 8, 2008

(54) DEVELOPER-CARRYING MEMBER HAVING IMPROVED TRANSPORTABILITY, A DEVELOPING UNIT, A PROCESS CARTRIDGE AND AN IMAGE FORMING APPARATUS

(75) Inventor: Tsuyoshi Imamura, Sagamihara (JP)

(73) Assignee: Ricoh Co., Ltd., Tokyo (JP)

( * ) Notice: Subject to any disclaimer, the term of this patent is extended or adjusted under 35 U.S.C. 154(b) by 72 days.

(21) Appl. No.: 11/353,119

(22) Filed: Feb. 14, 2006

(65) Prior Publication Data

US 2006/0193660 A1 Aug. 31, 2006

(30) Foreign Application Priority Data

Feb. 14, 2005 (JP) ..... 2005-036534
Jan. 11, 2006 (JP) ..... 2006-003996

(51) Int. Cl.
*G03G 15/08* (2006.01)

(52) U.S. Cl. ..... 399/286

(58) Field of Classification Search ..... 399/265, 399/267, 276, 279, 286
See application file for complete search history.

(56) References Cited

U.S. PATENT DOCUMENTS 4,018,187 A * 4/1977 Abbott et al. ..... 399/276
4,331,101 A * 5/1982 Muller et al. ..... 399/276
4,882,196 A * 11/1989 Shimamune et al. ..... 427/2.27
5,153,376 A * 10/1992 Tomita ..... 399/276
5,244,741 A 9/1993 Nagano et al.
5,970,294 A 10/1999 Narita et al.
6,070,038 A 5/2000 Imamura et al.
6,112,042 A 8/2000 Imamura et al.
6,198,895 B1 3/2001 Tsuda et al.
6,330,415 B1 12/2001 Imamura et al.
6,337,957 B1 1/2002 Tamaki et al.
6,480,691 B2 * 11/2002 Okada ..... 399/276

(Continued)

FOREIGN PATENT DOCUMENTS

JP 62-043676 2/1987

(Continued)

OTHER PUBLICATIONS

U.S. Appl. No. 11/353,119, filed Feb. 14, 2006, Imamura.
U.S. Appl. No. 11/775,455, filed Jul. 10, 2007, Imamura et al.

*Primary Examiner*—Sandra L. Brase
(74) *Attorney, Agent, or Firm*—Oblon, Spivak, McClelland, Maier & Neustadt, P.C.

(57) ABSTRACT

A developer-carrying member to transport a developer having a carrier to a developing area facing an image carrying member in an image forming apparatus includes a sleeve. The sleeve carries the developer. The surface of the sleeve has a maximum roughness Rmax of one-sixth or greater than a particle diameter of the carrier, and a surface index of 1.5 or greater. The surface index is expressed by the equation of "surface index=Rmax/($L_{total}$−LL)," in which LL is a measurement-range length selected from a roughness profile of the surface of the sleeve, $L_{total}$ is a total surface distance of the developer-carrying member in the measurement-range length LL, and Rmax is a maximum roughness of the sleeve surface, defined by a difference between a maximum roughness value and a minimum roughness value on a roughness profile of the surface of the sleeve.

21 Claims, 9 Drawing Sheets

U.S. PATENT DOCUMENTS

| | | | | |
|---|---|---|---|---|
| 6,522,855 | B1 | 2/2003 | Katoh et al. | |
| 6,681,092 | B2 * | 1/2004 | Terai | 399/267 |
| 6,697,593 | B2 | 2/2004 | Imamura et al. | |
| 7,027,761 | B2 | 4/2006 | Koetsuka et al. | |
| 2004/0018031 | A1 | 1/2004 | Imamura et al. | |
| 2004/0028428 | A1 * | 2/2004 | Sugihara | 399/267 |
| 2004/0113118 | A1 | 6/2004 | Kamoi et al. | |
| 2004/0258436 | A1 | 12/2004 | Nakamura et al. | |
| 2005/0031374 | A1 | 2/2005 | Nagashima et al. | |
| 2005/0063738 | A1 | 3/2005 | Kamiya et al. | |
| 2005/0111882 | A1 | 5/2005 | Sudo et al. | |
| 2005/0135843 | A1 | 6/2005 | Kakegawa et al. | |
| 2005/0281589 | A1 | 12/2005 | Sakai et al. | |

FOREIGN PATENT DOCUMENTS

| | | |
|---|---|---|
| JP | 5-25459 | 4/1993 |
| JP | 08-160736 | 6/1996 |
| JP | 09-236984 | 9/1997 |
| JP | 11-024301 | 1/1999 |
| JP | 2000-010336 | 1/2000 |
| JP | 2000-066505 | 3/2000 |
| JP | 2001-305862 | 11/2001 |
| JP | 2003-098756 | 4/2003 |
| JP | 2005-266271 | 9/2005 |

* cited by examiner

FIG. 14 NOTE : 1) ROUGHNESS TREATMENT FOR EX.1 TO 4 WAS CONDUCTED WITH SUS CUT-WRITE.
2) IQ : A (EXCELLENT), B (NORMAL), C (MINIMUM ALLOWABLE LEVEL), D (NOT-ALLOWABLE LEVEL)

| | SLEEVE TYPE | Rmax (μm) | Sm | SURFACE INDEX | INITIAL | | AFTER 50,000 | | AFTER 100,000 | | AFTER 100,000+ REPLACEMENT | |
|---|---|---|---|---|---|---|---|---|---|---|---|---|
| | | | | | TA | IQ | TA | IQ | TA | IQ | TA | IQ |
| COMP. EX. 1 | SAND-BLASTED | 13.50 | 45 | 0.057 | 50 | B | 30 | D (PATCHY) | 26 | D (PATCHY) | 40 | C (PATCHY) |
| COMP. EX. 2 | SAND-BLASTED | 10.80 | 40 | 0.078 | 50 | B | 30 | D (PATCHY) | 25 | D (PATCHY) | 40 | C (PATCHY) |
| COMP. EX. 3 | GROOVE ONLY | - | - | - | 50 | D (IMAGE UNEVENNESS/ LOW CONCENTRATION) | 45 | D (IMAGE UNEVENNESS/ LOW CONCENTRATION) | 42 | D (IMAGE UNEVENNESS/ LOW CONCENTRATION) | 50 | D (IMAGE UNEVENNESS/ LOW CONCENTRATION) |
| EX. 1 | ROUGHNESS TREATMENT ONLY | 5.81 | 100 | 2.790 | 50 | B | 40 | B | 35 | C | 50 | B |
| EX. 2 | ROUGHNESS TREATMENT ONLY | 9.34 | 120 | 1.740 | 50 | A | 43 | A | 39 | C | 50 | A |
| EX. 3 | GROOVE + ROUGHNESS TREATMENT | 9.34 | 120 | 1.740 | 50 | B | 43 | B | 40 | B | 50 | B |
| EX. 4 | GROOVE + ROUGHNESS TREATMENT | 9.30 | 130 | 2.980 | 50 | B | 44 | B | 41 | B | 50 | B |

DEVELOPER-CARRYING MEMBER HAVING IMPROVED TRANSPORTABILITY, A DEVELOPING UNIT, A PROCESS CARTRIDGE AND AN IMAGE FORMING APPARATUS

TECHNICAL FIELD

The present disclosure generally relates to a developing unit having a developer-carrying member to carry a developer thereon, and a process cartridge and an image forming apparatus having such developing unit.

BACKGROUND

Conventionally, a developing unit includes a developer-carrying member such as developing sleeve, for example. The surface of the developer-carrying can be treated with sandblasting to make a roughness condition on the surface of the developer-carrying member.

The developer-carrying member having a sandblasted surface can suppress a slipping of the developer on the developer-carrying member (e.g., developing sleeve) rotating at a high speed and a resultant accumulation of the developer on the developing sleeve. With such surface treatment on the developer-carrying member, degradation of image quality on a recording sheet may be prevented.

Sandblasting can be conducted by blasting particles on a surface of the developer-carrying member (e.g., a developing sleeve) made of metal (e.g., aluminum) to form convex and concave portions on the surface of the developer-carrying member, wherein such convex and concave portions have sharp profiles and a convex portion and an adjacent concave portion may exist with a relatively smaller interval therebetween.

Such sandblasted developer-carrying member can suppress slipping of developer on the developer-carrying member rotating in a high speed because the developer can be carried by the convex portions having sharp profiles.

However, such sandblasted surface of the developer-carrying member may have some drawbacks as to durability. Fox example, the sandblasted surface of the developer-carrying member become abraded over the time, the convex portions may lose their sharpness and the edges of the convex portions may become rounded. Such rounded convex portions may be less likely to carry the developer. In such a case, degradation of developer transportability on the developer-carrying member may happen.

Furthermore, the convex portions having sharp profiles may scrape toners and external additives on the carrier, and such scraped toners and external additives may drop into tiny concave portions on the developer-carrying member.

Such toners and external additives in the tiny concave portions may be fixed on the developing sleeve by heating, whereby such phenomenon may change the electrical resistance of the developer-carrying member. In such a case, degradation of developer transportability on the developer-carrying member may occur.

One known background image forming apparatus includes a developer-carrying member (e.g., developing sleeve) having been treated with a roughness treatment. Such developer carrying member has a surface which has a ten-point average roughness of from 4 μm to 20 μm, and an average interval Sm of from 30 μm to 80 μm, for example, wherein the average interval Sm indicating a surface condition is explained as below with respect to FIG. 1.

As shown in FIG. 1, a measurement-range length "d" is selected from a roughness profile of the developer-carrying member to determine the surface condition on the developer-carrying member.

As shown in FIG. 1, one mountain area and an adjacent one valley area consist of one Sm, wherein the mountain area is an area which is defined by an roughness profile line coming to an upper side of an average profile line, and the valley area is an area which is defined by a roughness profile line coming to a lower side of an average profile line.

As shown in FIG. 1, a plurality of intervals Sm (e.g., Sm1 and Sm2) are measured in the measurement-range length "d." By averaging the values of the plurality of intervals Sm, a value of the average interval Sm can be determined.

In one example, a developer-carrying member has an average interval Sm of from 30 μm to 80 μm as above-mentioned, wherein such developer-carrying member may have a relatively larger average interval Sm compared to another conventional developer-carrying member. Thereby the above-mentioned developer-carrying member having the average interval Sm of from 30 μm to 80 μm may have a relatively mild roughness compared to another conventional developer-carrying member.

Unlike another conventional developer-carrying member carrying carriers on its surface by carrying carriers with sharp convex portions, such developer-carrying member having a relatively mild roughness on its surface can carry carriers on the developing sleeve by carrying carriers in concave portions formed on the surface of the developer-carrying member.

Therefore, such developer-carrying member having a relatively mild roughness on its surface may not change its surface shape significantly over time compared to a conventional developer-carrying member having sharp convex portions, whereby developer transportability on such developer-carrying member may be maintained over time.

Furthermore, such developer-carrying member having a relatively mild roughness on its surface rarely has sharp convex portions, whereby toner particles and external additives on carriers may not be scraped by the convex portions. If the toner particles and external additives on carriers are not scraped, toner particles and external additives will not drop into tiny concave portions on the surface of the developer-carrying member, and will not be fixed in the tiny concave portions.

However, using the average interval Sm to determine a roughness of the surface of the developer-carrying member (e.g., developing sleeve) may have a drawback as described below.

For example, assuming that a developer-carrying member has waviness on a surface of the developer-carrying member as shown in FIG. 1, such waviness is shown as a dotted line in FIG. 1.

In such a case, the average interval Sm determined based on such waviness may be construed as concave-and-convex portions formed on the surface of the developer-carrying member.

However, such waviness may not express an actual roughness profile line (shown as a solid line in FIG. 1) consisting of discrete concave and convex portions formed on the surface of the developer-carrying member, whereby an actual surface condition having discrete concave and convex portions may not be determined by the average interval Sm.

Specifically, even if actual discrete concave and convex portions exist on the surface of the developer-carrying member, the average interval Sm may show a larger value, which does not express actual concave and convex portions on the surface of the developer-carrying member, for example.

Therefore, the average interval Sm may not be a preferable indicator to determine the condition of a surface having a number of discrete concave and convex portions.

If tiny concave portions exist on the surface of the developer-carrying member, particles such as toner may adhere on such tiny concave portions. In such a case, the developer-carrying member may degrade its functions (e.g., degradation of developer transportability and developing capability) over the time.

SUMMARY

The present disclosure relates to a developer-carrying member to transport a developer having a carrier to a developing area facing an image carrying member in an image forming apparatus. The developer-carrying member includes a sleeve and the sleeve carries the developer. The surface of the sleeve has a maximum roughness Rmax of one-sixth or greater than a particle diameter of the carrier, and a surface index of 1.5 or greater. The surface index is expressed by the equation "surface index=Rmax/($L_{total}$−LL)," in which LL is a measurement-range length selected from a roughness profile of the surface of the sleeve, $L_{total}$ is a total surface distance of the developer-carrying member in the measurement-range length LL, and Rmax is a maximum roughness of the sleeve surface, defined by a difference between a maximum roughness value and a minimum roughness value on a roughness profile of the surface of the sleeve.

The present disclosure relates to a developing unit for use in an image forming apparatus to develop an electrostatic latent image formed on an image carrying member. The developing unit includes a developer container and a developer-carrying member. The developer container contains a developer having a carrier. The developer-carrying member transports the developer to a developing area facing an image carrying member in the image forming apparatus. The developer-carrying member includes a sleeve. The sleeve carries the developer. The surface of the sleeve has a maximum roughness Rmax of one-sixth or greater than a particle diameter of the carrier, and a surface index of 1.5 or greater. The surface index is expressed by the equation "surface index=Rmax/($L_{total}$−LL)," in which LL is a measurement-range length selected from a roughness profile of the surface of the sleeve, $L_{total}$ is a total surface distance of the developer-carrying member in the measurement-range length LL, and Rmax is a maximum roughness of the sleeve surface, defined by a difference between a maximum roughness value and a minimum roughness value on a roughness profile of the surface of the sleeve.

The present disclosure relates to an image forming apparatus. The image forming apparatus includes a charging unit, an image carrying member, a developing unit, and a cleaning unit. The image carrying member, charged by the charging unit, forms an electrostatic latent image thereon. The developing unit develops the electrostatic latent image formed on the image carrying member with a developer. The developing unit includes a developer container and a developer-carrying member. The developer container contains the developer having a carrier and a toner. The developer-carrying member transports the developer to a developing area facing the image carrying member. The developer-carrying member includes a sleeve and the sleeve carries the developer. The surface of the sleeve has a maximum roughness Rmax of one-sixth or greater than a particle diameter of the carrier, and a surface index of 1.5 or greater. The surface index is expressed by the equation "surface index=Rmax/($L_{total}$−LL)," in which LL is a measurement-range length selected from a roughness profile of the surface of the sleeve, $L_{total}$ is a total surface distance of the developer-carrying member in the measurement-range length LL, and Rmax is a maximum roughness of the sleeve surface, defined by a difference between a maximum roughness value and a minimum roughness value on a roughness profile of the surface of the sleeve. The cleaning unit removes the toner remaining on the image carrying member after transferring an image to a transfer member.

BRIEF DESCRIPTION OF THE DRAWINGS

A more complete appreciation of the disclosure and many of the attendant advantages and features thereof can be readily obtained and understood from the following detailed description with reference to the accompanying drawings, wherein.

Figure 12A:
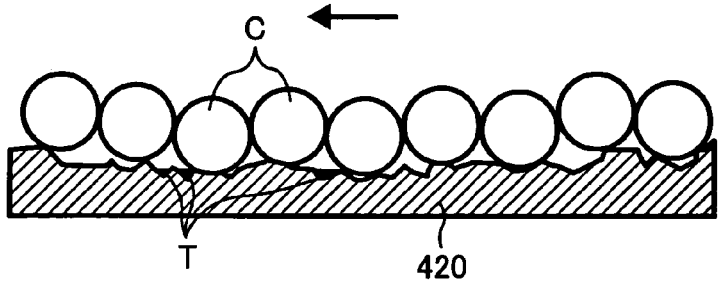
Figure 12B:
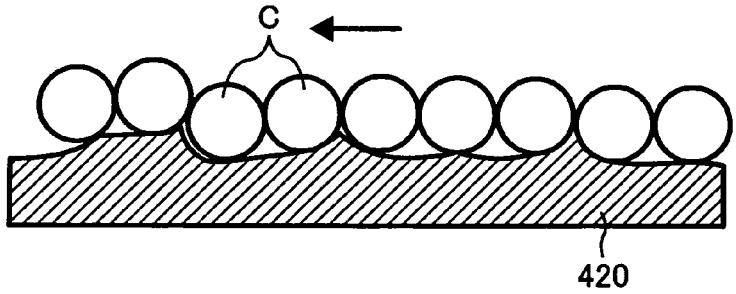
Figure 13:
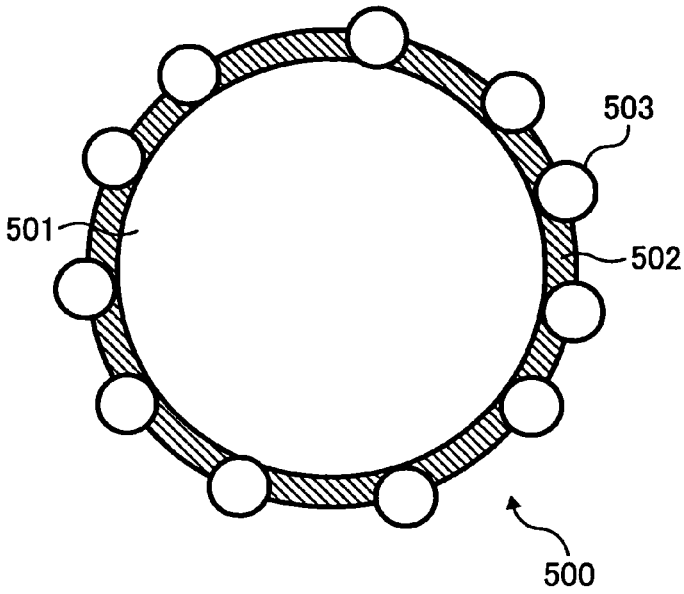

FIG, 12A is a schematic view explaining a carrier transport condition on a developing sleeve treated by a conventional sandblasting;

FIG. 12B is a schematic view explaining a carrier transport condition on a developing sleeve treated by a blasting according to an example embodiment;

FIG. 13 is a schematic sectional view of a carrier according to an example embodiment; and FIG. 14 is a chart showing a result of Examples according to an example embodiment and Comparative Examples.

DETAILED DESCRIPTION OF THE PREFERRED EMBODIMENTS

In describing the exemplary embodiments shown in the drawings, specific terminology is employed for the sake of clarity. However, the disclosure of this present invention is not intended to be limited to the specific terminology so selected and it is to be understood that each specific element includes all technical equivalents that operate in a similar manner.

Referring now to the drawings, wherein like reference numerals designate identical or corresponding parts throughout the several views, an image forming apparatus according to an example embodiment is described with reference to FIG. 2.

Figure 1:
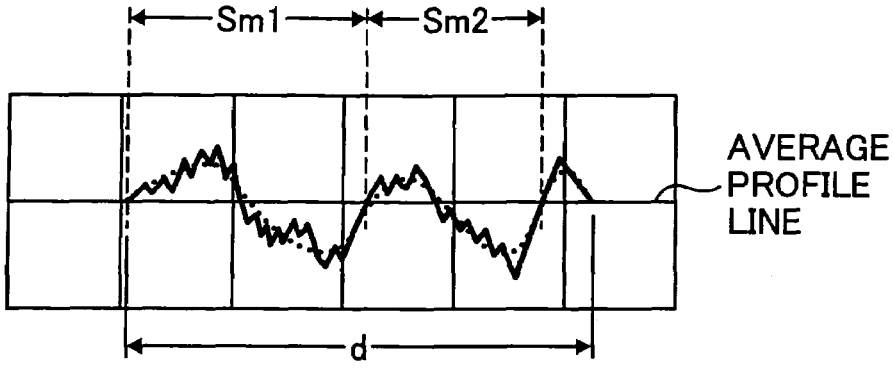
FIG. 1 is a schematic chart explaining an average interval Sm on a developing sleeve.
Figure 2:
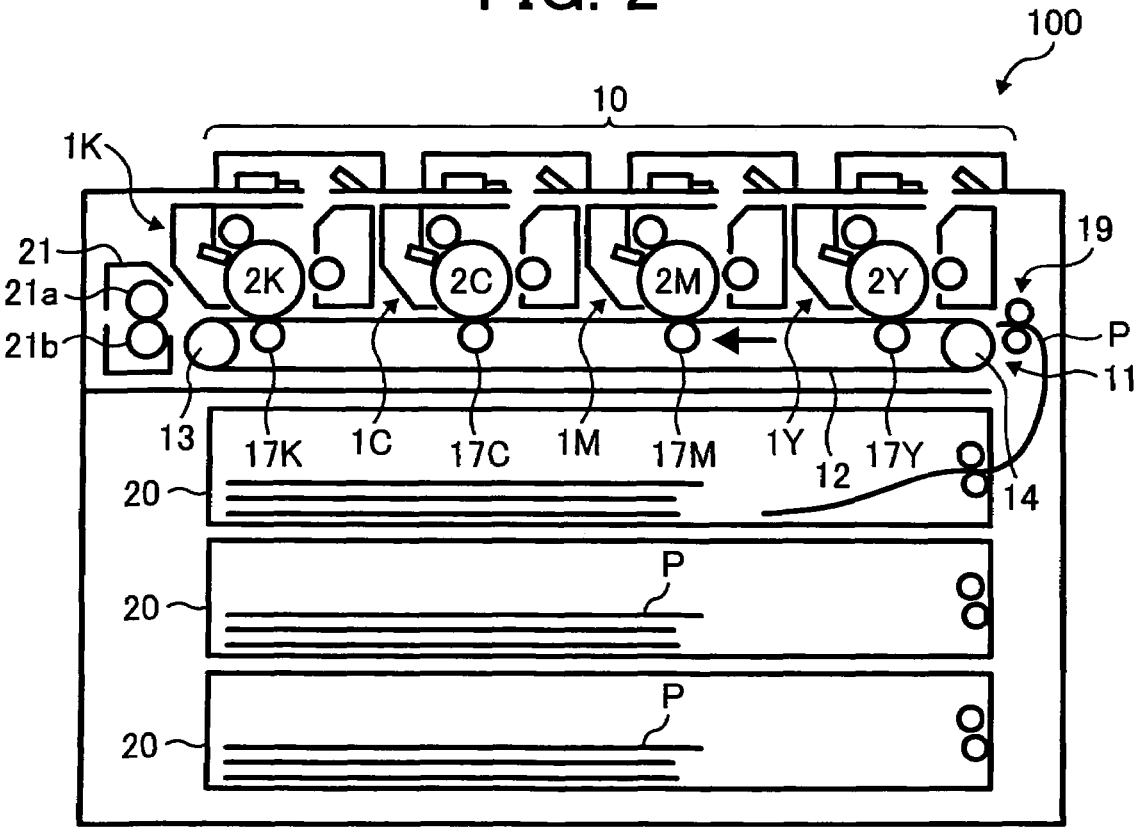
FIG. 2 is a schematic sectional view of an image forming apparatus according to an example embodiment.

FIG. 2 is a schematic view of an image forming apparatus 100 according to an exemplary embodiment. The image forming apparatus 100 may include a printer such as a color laser printer of tandem type using an electro-photography method, for example.

The image forming apparatus 100 includes four process units 1Y, 1M, 1C, and 1K for forming images corresponding to yellow image (Y), magenta image (M), cyan image (C), and black image (K) forming.

Hereinafter, reference characters Y, M, G, and K are used to indicate that each components having Y, M, C, and K relates to yellow, magenta, cyan, and black image forming, respectively.

The image forming apparatus 100 also includes an optical writing unit 10, a transfer unit 11, a pair of registration rollers 19, sheet cassettes 20, and a fixing unit 21.

The optical writing unit 10 includes four writing units to write images corresponding to yellow image (Y), magenta image (M), cyan image (C), and black image (K). Although not shown, the optical writing unit 10 also includes a light source, a polygon mirror, an f-theta lens, and a reflection mirror, for example.

The optical writing unit 10 emits a laser beam corresponding to image data to the surface of a photoconductive member to be described later.

Figure 3:
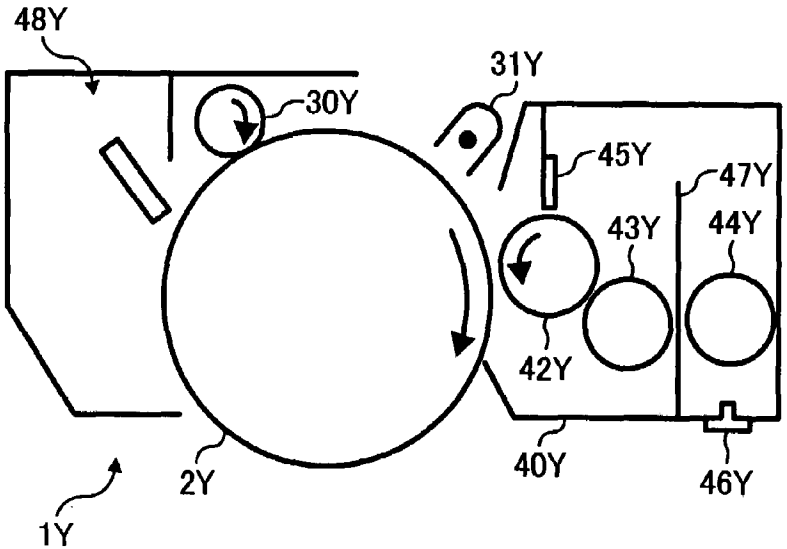
FIG. 3 is a schematic sectional view of a process cartridge of an image forming apparatus in FIG. 2.

FIG. 3 is an expanded schematic view of the process unit 1Y. Because the process units 1Y, 1M, 1C, and 1K have a substantially similar configuration with respect to one another, the process unit 1Y is explained hereinafter as a representative unit of the process units 1Y, 1M, 1C, and 1K. As shown in FIG. 3, the process unit 1Y includes a photosensitive member 2Y in drum shape, a charger 30Y, a developing unit 40Y, and a drum cleaning unit 48Y.

In an example embodiment, the process unit 1Y can integrate the above-mentioned components and can be used as one unit, by which the process unit 1Y can be detached from the image forming apparatus 100 as one process cartridge.

The charger 30Y includes a charge roller to be applied with alternative voltage from a power source (not shown), wherein the charge roller can be contacted to the photosensitive member 2Y to charge a surface of the photosensitive member 2Y uniformly.

The charged surface of the photosensitive member 2Y is scanned by a laser beam emitted from the optical writing unit 10 to form an electrostatic latent image on the surface of the photosensitive member 2Y. The developing unit 40Y develops the electrostatic latent image on the surface of the photosensitive member 2Y as yellow toner image.

As shown in FIG. 3, the developing unit 40Y includes a developing roller 42Y, wherein a part of the developing roller 42Y is exposed to an outside of a casing of the developing unit 40Y.

Furthermore, the developing unit 40Y also includes a first transport screw 43Y, a second transport screw 44Y, a doctor blade 45Y, and a toner concentration sensor 46Y (hereinafter, referred as "T sensor 46Y"), and a separation wall 47Y.

The casing of the developing unit 40Y can contain a two-component developer, which includes magnetic carriers and yellow toners to be negatively charged, for example.

The two-component developer is agitated and transported by the first transport screw 43Y and second transport screw 44Y and is charged by friction caused by such agitation and transportation by the first transport screw 43Y and second transport screw 44Y. Then, the charged two-component developer is carried onto a surface of the developing roller 42Y.

The doctor blade 45Y adjusts a layer thickness of the two-component developer on the surface of the developing roller 42Y.

Then, the two-component developer on the developing roller 42Y comes to a developing area, which faces the photosensitive member 2X, and yellow toners of the two component developer adhere to the electrostatic latent image formed on the photosensitive member 2Y to form a yellow toner image on the photosensitive member 2Y.

The two-component developer, which released yellow toners by such developing process, returns into the casing of the developing unit 40Y with a rotation of the developing roller 42Y.

As shown in FIG. 3, the first transport screw 43Y and the second transport screw 44Y are separated by the separation wall 47Y.

The separation wall 47Y separates a first supply compartment and a second supply compartment in the casing of the developing unit 40Y, wherein the first supply compartment includes the developing roller 42Y and the first transport screw 43Y, and the second supply compartment includes the second transport screw 44Y as shown in FIG. 3.

The first transport screw 43Y, driven by a driving device (not shown), transports the two-component developer in the first supply compartment in one direction, and supplies the two-component developer to the developing roller 42Y.

The two-component developer, transported to an end portion of the first supply compartment by the first transport screw 43Y, goes into the second supply compartment from an opening portion (not shown) provided at an end portion of the separation wall 47Y.

The second transport screw 44Y, driven by a driving device (not shown), transports the two-component developer in the second supply compartment in a direction which is an opposite direction with respect to the transportation direction by the first transport screw 43Y in the first supply compartment.

The two-component developer, transported to an end portion of the second supply compartment by the second transport screw 44Y, goes back into the first supply compartment from another opening portion (not shown) provided at another end portion of the separation wall 47Y. The T sensor 46Y includes a magnetic permeability sensor, for example.

The T sensor 46Y can be provided on a bottom face of the second supply compartment, and outputs a voltage signal corresponding to magnetic permeability of the two-component developer passing over the T sensor 46Y.

The magnetic permeability of the two-component developer correlates to toner concentration, thereby the T sensor 46Y outputs a voltage signal corresponding to yellow toner concentration in the two-component developer.

Such voltage signal is then transmitted to a control unit (not shown). The control unit includes a RAM (random access memory), in which a target voltage value of "Vtref"

for yellow toner is stored, and target voltage values of "Vtref" for magenta toner, cyan toner, and black toner are also stored.

The "Vtref" for yellow toner is used to control a yellow toner supply unit (not shown), which supplies yellow toners to the second supply compartment. Specifically, the control unit controls a driving of the yellow toner supply unit (not shown) so that a voltage signal transmitted by the T sensor 46Y can be within an allowable range from the "Vtref" for yellow toner.

With such toner supplying mechanism, the yellow toner concentration of the two-component developer in the developing unit 40Y can be maintained in a predetermined range. Similar toner supplying mechanism can be conducted for other developing units in other process units for magenta, cyan, and black image.

In general, a developing gap between the photosensitive member 2Y and the developing roller 42Y is set to a relatively smaller value to improve granularity of toner image developed on the photosensitive member 2Y because such improvement of granularity of toner image leads to a production of an image having higher quality on a recording sheet.

If the developing gap between the photosensitive member 2Y and the developing roller 42Y becomes too large, the electric field intensity between the photoconductive member 2Y and the developing roller 42Y may become too small. In such a case, toner adhesion to the electrostatic latent image on the photosensitive member 2Y may not be conducted effectively, and an edge effect of the electric field may become stronger at edge portions of images developed on the photosensitive member 2Y, which are not favorable to produce an image having uniform granularity on a recording sheet.

If the developing gap between the photosensitive member 2Y and the developing roller 42Y becomes too small, the electric field intensity between the photoconductive member 2Y and the developing roller 42Y may become too strong. In such case, toners may more likely become fixed to the developing roller 42Y, which is not favorable.

In an exemplary embodiment, the developing gap between the photosensitive member 2Y and the developing roller 42Y is preferably set to from 0.1 mm to 0.4 mm, for example.

The yellow toner image formed on the photosensitive member 2Y is transferred to a recording sheet such as transfer sheet P transported by a sheet transport belt.

After transferring the yellow toner image, the drum cleaning unit 48Y removes toners remaining on the surface of the photosensitive member 2Y, and then the photosensitive member 2Y is de-charged by a de-charger 31Y to prepare for a next image forming operation.

The above-mentioned processes can be conducted similarly for other process units for magenta, cyan, and black image.

Each of the process units is detachable from the image forming apparatus 100, and can be replaced when a lifetime of the process units comes to an end.

As shown in FIG. 2, the transfer unit 11 includes a sheet transport belt 12, a drive roller 13, a tension roller 14, and transfer bias rollers 17Y, 17M, 17C, and 17K.

The sheet transport belt 12 is extended by the drive roller 13 and the tension roller 14, and is driven in a direction shown by an arrow in FIG. 2 by the drive roller 13, wherein the drive roller 13 is driven by a driving unit (not shown).

The transfer bias rollers 17Y, 17M, 17C, and 17K are applied with a transfer bias voltage from a power source (not shown).

Each of the transfer bias rollers 17Y, 17M, 17C, and 17K and the corresponding photosensitive members 2Y, 2M, 2C, and 2K define a transfer nip by sandwiching the sheet transport belt 12 therebetween.

At each transfer nip, an electric field is formed between the photoconductive member 2 and the transfer bias roller 17 with an effect of the transfer bias voltage.

The yellow toner image formed on the photosensitive member 2Y is transferred to the transfer sheet P by the effect of the electric field and nip pressure, wherein the transfer sheet P is transported on the sheet transport belt 12.

Then, magenta, cyan, and black toner images formed on the respective photoconductive members 2M, 2C, and 2K are sequentially and super-imposingly transferred onto the yellow toner image formed on the transfer sheet P.

With such superimposed transfer of toner images, a full color toner image can be formed on the transfer sheet P.

In an exemplary embodiment, a plurality of sheet cassettes 20 are disposed under the transfer unit. 11 in a multi-decked manner, wherein each of the sheet cassettes 20 stores a plurality of transfer sheets therein.

A top sheet of the transfer sheets in the sheet cassettes 20 contacts a sheet feed roller. When the sheet feed roller is driven at a predetermined timing, the top sheet of the transfer sheets is fed to a sheet transport route.

The transfer sheet P, fed to the sheet transport route from the sheet cassettes 20, is then sandwiched between the pair of registration rollers 19. The pair of registration rollers 19 feed the transfer sheet P to the sheet transport belt 12 by adjusting a sheet feed timing with a transfer tinning of toner images at the transfer nip. Then, each of the toner images is sequentially transferred to the transfer sheet P at the each transfer nip.

The transfer sheet P having a full color toner image thereon is transported to the fixing unit 21.

As shown in FIG, 2, the fixing unit 21 includes a heat roller 21*a* and a pressure roller 21*b*, by which a fixing nip is formed.

The heat roller 21*a* includes a heat source such as halogen heater therein, and the pressure roller 21*b* is pressed toward the heat roller 21*a*.

The heat roller 21*a* and the pressure roller 21*b* apply heat and pressure to the transfer sheet P at the fixing nip to fix the full color toner image on the surface of the transfer sheet P.

Then, the transfer sheet P is ejected out of the image forming apparatus 100 under the effect of a pair of sheet ejection rollers (not shown).

Hereinafter, the developing roller 42 is explained in detail.

Figure 4:
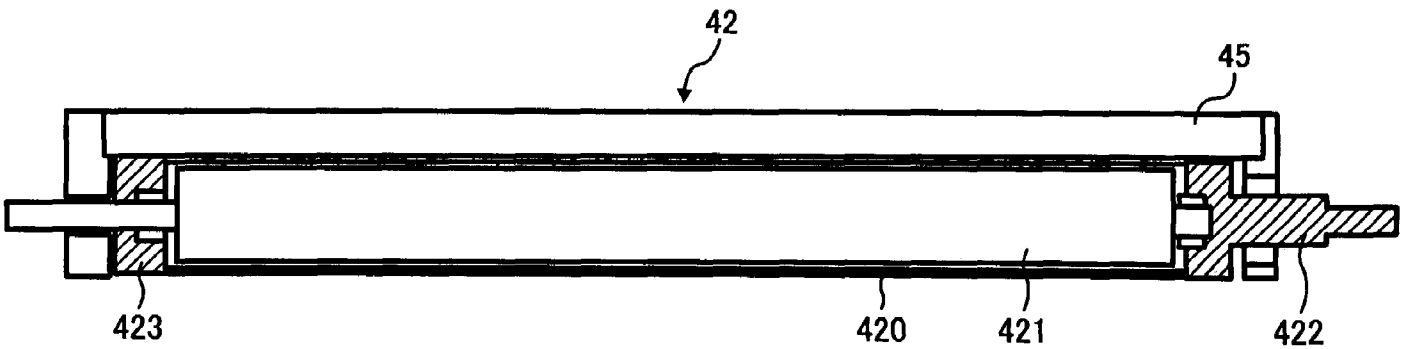
FIG. 4 is a schematic sectional view of a developing roller of an image forming apparatus in FIG. 2.

FIG. 4 is a schematic sectional view of the developing roller 42, wherein the developing roller 42 includes a developing sleeve 420 and a magnet roller 421.

Figure 5A:
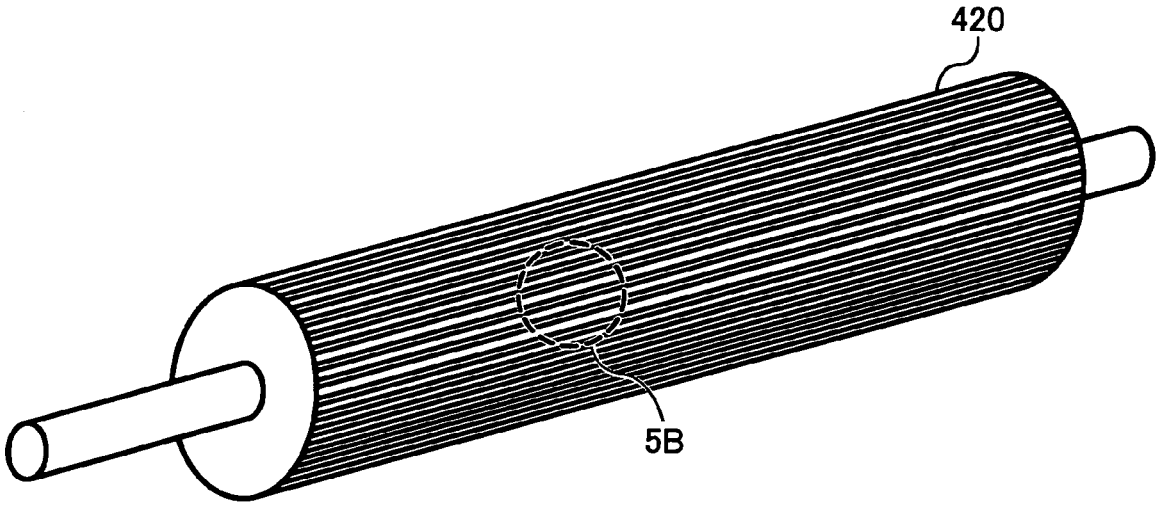
FIG. 5A is a schematic perspective view of a developing roller in FIG. 4.
Figure 5B:
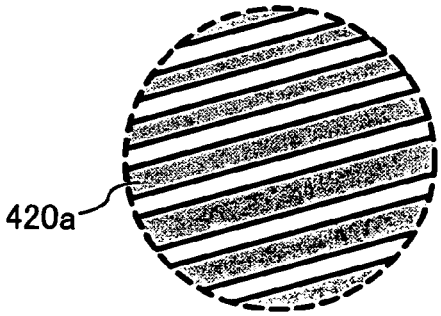
FIG. 5B is a schematic expanded view of a surface of a developing sleeve in FIG. 5A.

FIGS. 5A and 5B are schematic perspective views of the developing sleeve 420 of the developing roller 42.

As shown in FIG. 4, at both ends of the developing sleeve 420, each of flanges 422 and 423 engage with an inner surface of the developing sleeve 420. The magnet roller 421 is encased in the developing sleeve 420.

Furthermore, the developing roller 42 is provided with a doctor blade 45, wherein the doctor blade 45 extends in an axial direction of the developing sleeve 420 by setting a predetermined gap interval with a surface of the developing sleeve 420.

As shown in FIGS. 5A and 5B, the surface of the developing sleeve 420 includes a plurality of grooves 420*a* extending in an axial direction of the developing sleeve 420.

A groove depth is set at a value at least greater than a weight average diameter of the magnetic carrier of the two-component developer, and is one-half or less of the developing gap between the photoconductive member and the developing roller.

If the groove depth is too small, developer transportability on the developing sleeve may not be maintained at favorable level over the time.

If the groove depth is too large, an image produced on a recording sheet may show image unevenness, which may correspond to a pitch of grooves.

In an exemplary embodiment, the pitch of grooves is preferably set from 0.5 mm to 1.5 mm, for example.

If the pitch of grooves becomes too large, effective developer transportability on the developing sleeve may not be obtained.

If the pitch of grooves becomes too small, such grooves may influence a quality of image to be produced on a recording sheet in a greater degree. Specifically, variations of groove depth may affect image quality.

A condition of the surface of the developing sleeve 420 can be defined by using a maximum surface roughness "Rmax" of the developing sleeve 420.

In an exemplary embodiment, the maximum surface roughness "Rmax" is one sixth or greater of a carrier particle diameter. The maximum surface roughness "Rmax" is preferably one fifth or greater of the carrier particle diameter, and further preferably one third or greater of the carrier particle diameter.

In an another exemplary embodiment, the surface of the developing sleeve 420 receives a roughness treatment and has a surface index of 1.5 or greater, wherein the surface index can be defined by a equation 1 as mentioned below.

$$\text{Surface index}=\text{Rmax}/(L_{total}-LL) \quad \text{(equation 1)}$$

wherein LL is a measurement-range length, $L_{total}$ is a total surface distance of the developing sleeve in the measurement-range length LL, and $L_{total}$ can be defined by a equation 2 as below.

$$L_{total}=\Sigma Ln \quad \text{(equation 2)}$$

wherein "Ln" is a distance between adjacent two points on the developing sleeve, wherein such points are explained later with reference to FIGS. 6A and 6B.

Figure 6A:
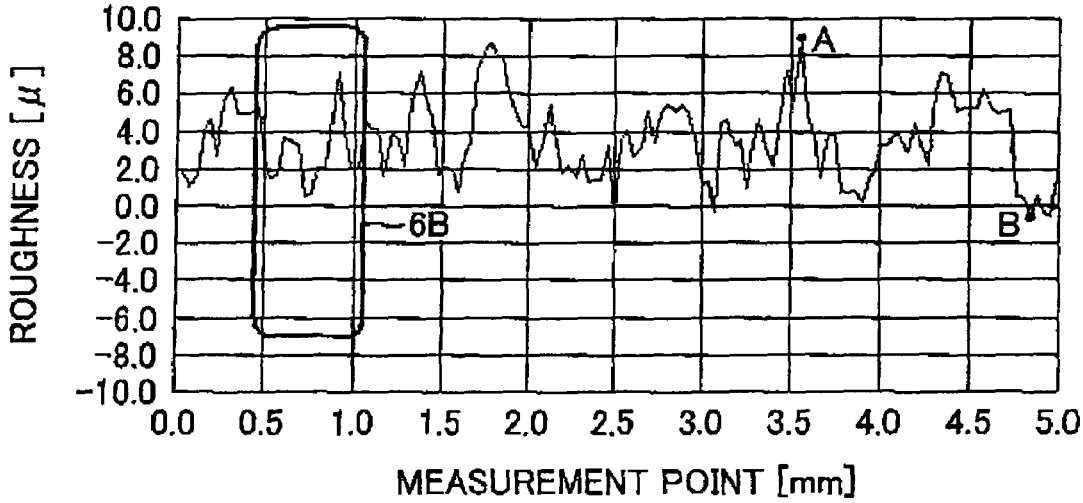
FIG. 6A is a schematic chart explaining a roughness profile of a developing sleeve surface.
Figure 6B:
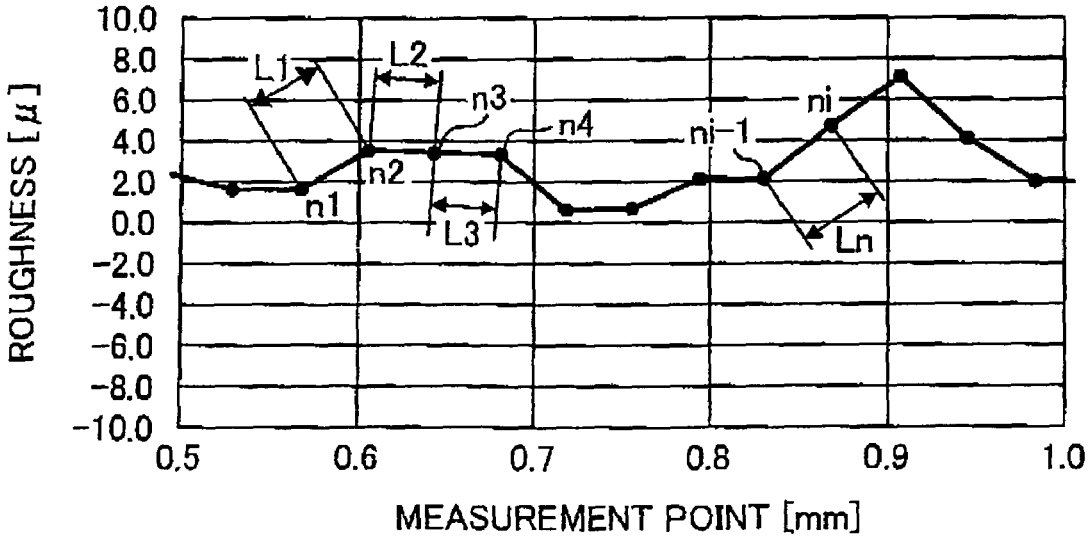
FIG. 6B is a schematic expanded view of roughness profile in FIG. 6A for explaining a method of computing a surface distance in a measurement range of 0.5 to 1.0 mm in FIG. 6A.

With reference to FIGS. 6A and 6B, the method of computing $L_{total}$ and Rmax is explained as below.

At first, a roughness profile of the developing sleeve surface is measured. FIG. 6A is a schematic chart explaining a roughness profile of a developing sleeve surface, and FIG. 6B is a schematic expanded view of roughness profile of a developing sleeve surface in FIG. 6A.

FIG. 6B is an exemplary roughness profile for explaining a method of computing "ΣLn" in a measurement-range length of from 0.5 mm to 1.0 mm.

The roughness profile of a developing sleeve surface can be measured with a measurement device such as a laser displacement sensor having a laser spot diameter of 10 μm or less, for example.

The laser displacement sensor scans a predetermined length of the developing sleeve (i.e., measurement-range length LL) with a measurement pitch of approximately 6 μm to measure the roughness on the developing sleeve in the measurement-range length LL.

The smaller the measurement pitch is, the more accurate the measurement of a roughness on a developing sleeve surface becomes. However, if the measurement pitch is too small, a longer time period is required for data processing, which is not preferable.

In an exemplary embodiment, the roughness profile of a developing sleeve surface is measured with a measurement patch of approximately 6 μm, for example.

In another exemplary embodiment, the measurement-range length LL is set to 5 mm, for example.

If the measurement-range length LL is too small, variations of $L_{total}$ may become larger, which is not preferable.

The measurement-range length LL can be set at a larger a larger value such as more than 5 mm. However, a result of surface index determined by using the measurement-range length LL of more than 5 mm may substantially similar to the result of surface index determined by using the measurement-range length LL of 5 mm.

Accordingly, a longer measurement-range length (e.g., more than 5 mm) may not be preferable considering a measurement time and data processing time.

The Rmax value can be computed by subtracting a minimum roughness value from a maximum roughness value on a roughness profile of the developing sleeve surface.

For example, the roughness profile in FIG. 6A, Rmax can be computed by subtracting a minimum roughness value at a point H from a maximum roughness value at a point A.

As shown in FIG. 6B, each Ln value is computed as below. Each Ll to Ln value is computed based on the roughness measurement between two adjacent measurement points of nl to ni with a predetermined measurement pitch such as 6 μm.

For example, a first distance Ll for two adjacent measurement points of nl and n2 is computed. Similarly, a second distance L2 for two adjacent measurement points of n2 and n3 is computed. With such computing, each distance of Ll to Ln between two adjacent measurement points is computed. In an example embodiment, the measurement-range length LL is 5 mm, for example. By summing up Ll to Ln in the measurement-range length LL of 5 mm, $L_{total}$ can be computed.

In FIG. 6B, for the sake of explanation of computing Ln, a measurement pitch is shown in a relatively larger value, however, as above-mentioned the measurement pitch of approximately 6 μm is actually used for an example embodiment.

With the above-mentioned method, the $L_{total}$ value can be obtained.

As can be understand from FIGS. 6B, there is a difference between the measurement-range length LL and the $L_{total}$, wherein such difference can be obtained by subtracting the measurement-range length LL from the $L_{total}$, and such difference is referred as "surface-distance difference" of the developing sleeve surface for the sake of explanation, hereafter.

In general, $L_{total}$ becomes longer as the maximum surface roughness Rmax becomes greater.

Accordingly, a surface index, which indicates a surface condition, can be obtained by dividing the maximum surface roughness Rmax with the "surface-distance difference," which is expressed by the above-mentioned equation 1.

$$\text{Surface index}=\text{Rmax}/(L_{total}-LL) \quad \text{(equation 1)}$$

If the surface index takes a smaller value, it means a larger "surface-distance difference". The larger "surface-distance difference" indicates that a density of mountain areas on the developing sleeve becomes greater.

If the surface index takes a larger value, it means a smaller "surface-distance difference". The smaller "surface-distance difference" indicates that a density of mountain areas becomes smaller. In such a case, the developing sleeve surface has relatively mild concave-and-convex portions thereon.

As above explained, the surface index is used to judge a density degree of the mountain areas on the developing sleeve by using the above-described total surface distance on the developing sleeve.

With such method, the roughness of the surface of the developing sleeve can be measured more precisely. Hereinafter, a method of manufacturing the developing sleeve 420 according to an example embodiment is explained.

At first, a metal material such as aluminum is formed into a cylinder shape by a hot extrusion process, for example.

The developing sleeve 420 can be made of other materials such as brass, stainless steel, and an electric conductive resin in addition to aluminum, for example. However, the developing sleeve 420 is preferably made of aluminum in view of cost and manufacturing precision of a finished product.

Hereinafter, the aluminum tube formed in cylinder shape is referred as developing sleeve.

Such developing sleeve is inserted in a dice having a convex-shaped portion such as trapezoidal shape, V-shape, and U-shape on a surface of the dice, and then the developing sleeve is withdrawn from the dice with a cold extrusion process, for example.

With such process, grooves can be formed on the developing sleeve, wherein the grooves extend in an axial direction of the developing sleeve.

The inner diameter of the dice can be set equal to an outer diameter of the developing sleeve or set slightly smaller than an outer diameter of developing sleeve. If such dice is used, the vibration level of the developing sleeve and the outer diameter of the developing sleeve may be set to a preferable level when forming grooves on the developing sleeve.

Although the grooves can be formed on the developing sleeve with a cold extrusion process as above-mentioned, a hot extrusion process can be also used for forming grooves on the developing sleeve.

After forming the developing sleeve 420, the flange 423 is pressed and fixed at one end of the developing sleeve 420. The flange 423 is integrally formed with the boss portion 423*a* as shown in FIG. 7A.

Figure 7A:
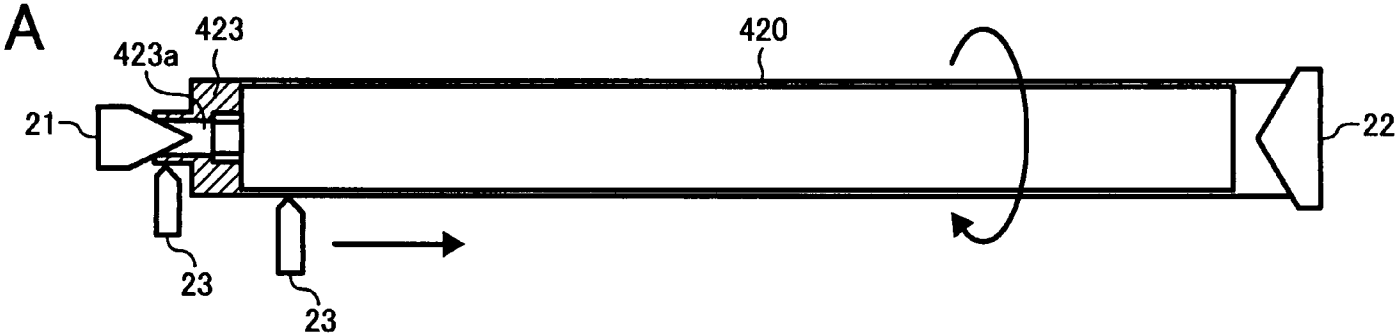
FIGS. 7A and 7B show a schematic process explaining a cutting work on a developing sleeve.

A cutting process of the developing sleeve 420 is conducted by using the boss portion 423*a* as a reference position as shown in FIG. 7A, At first, the boss portion 423*a* is held by a holding device 21 of a cutting machine and a guide device 22 of the cutting machine holds the other end of the developing sleeve 420 as shown in FIG. 7A. The holding device 21 is rotated to rotate the developing sleeve 420.

Then, a cutting tool 23 is slidably moved on the developing sleeve 420 in an axial direction of the developing sleeve 420. Such cutting is continued until a vibration level of the developing sleeve 420 can be set to 20 μm or less, for example.

Furthermore, an outer face of the boss portion 423 is cut so that a vibration level of the boss portion 423 can be set to a similar level of the developing sleeve 420.

After the cutting process, a roughness treatment is conducted on a surface of the developing sleeve 420.

Specifically, a plurality of cut-wires (shown in FIG. 8) made of metal are impacted on the surface of the developing sleeve 420 while orienting a bottom face of the cut-wire to the surface of the developing sleeve 420, wherein such impact process can be conducted in a similar manner to that of sandblasting.

Figure 8:
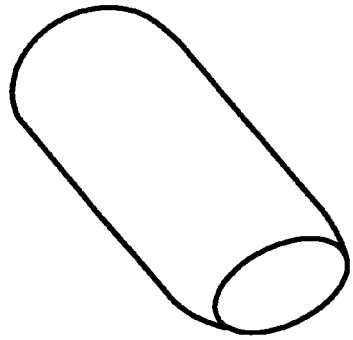
FIG. 8 is a schematic perspective view of a cut-wire.

The cut-wire shown in FIG. 8 can be made of metal such as SUS (stainless used steel) and has a cylinder column shape having a diameter of 0.8 mm to 1.4 mm and a length of 5 mm, for example, wherein such cylinder column shaped metal can be prepared by cutting a metal wire into pieces.

With the above-described impacting method, the developing sleeve surface is formed into a rough surface having a relatively mild concave-and-convex portions and a relatively larger interval between mountain areas.

Figure 9B:
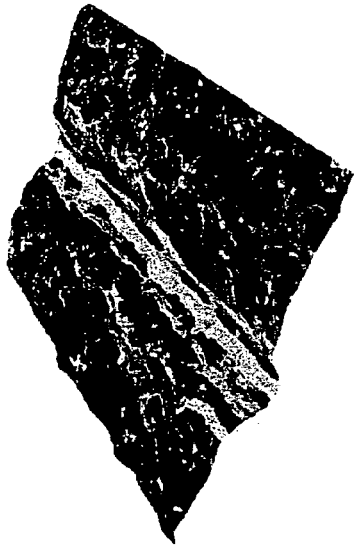
FIG. 9B shows a schematic surface condition of a developing sleeve after roughness treatment.
Figure 9A:
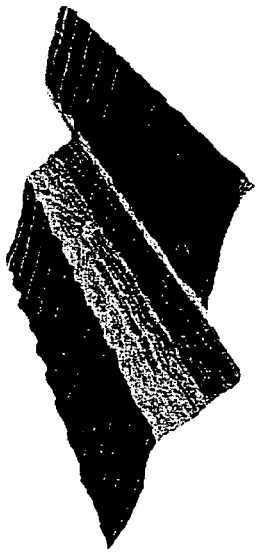
FIG. 9A shows a schematic surface condition of a developing sleeve before roughness treatment.

FIG. 9A shows a surface condition of a developing sleeve before roughness treatment, and FIG. 9B shows a surface condition of a developing sleeve after roughness treatment.

As shown in FIG. 9B, the edge portion of the groove is formed into a rounded shape by the roughness treatment. Hereinafter such rounded shape at the edge portion of the groove is referred to as being an "R-shape".

After forming the grooves on the developing sleeve surface, a roughness treatment is conducted on the developing sleeve surface to make the edge portion of the groove into the "R-shape," wherein such method has a favorable aspect as below.

In case of a developing sleeve surface having been treated by roughness treatment before forming grooves on the developing sleeve surface, the edge portion of the groove is not formed into an "R-shape." When such developing sleeve is abraded over the time, the edge portion of the groove assumes an "R-shape," thereby the edge portion changes its shape over the time. If the edge portion changes its shape, developer transportability on the developing sleeve may be varied over the time.

On the one hand, in case of a developing sleeve surface having treated by roughness treatment after forming grooves on the developing sleeve surface, the edge portion of the groove can be formed into an "R-shape." Even if such edge portion is abraded over the time, the shape of the edge portion may be maintained in an "R-shape" over the time. Therefore, degradation of developer transportability on the developing sleeve over the time can be suppressed.

Figure 7B:
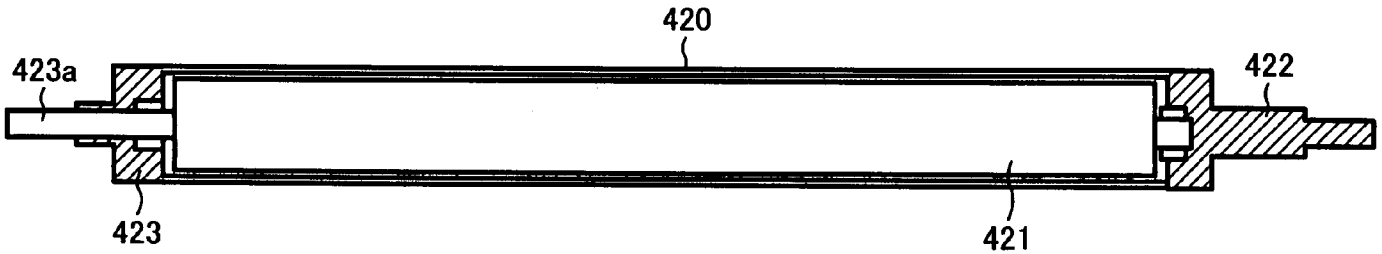

As shown in FIG. 7B, the magnet roller 421 is inserted in the developing sleeve 420 having a surface treated by roughness treatment. Then, the flange 422 is fixed at one end of the developing sleeve 420 to form the developing roller 42.

In the above-described developing roller 42, the flange 423 is fixed at one end of the developing sleeve 420 before conducting a cutting process on the developing roller 42. However, another process can be conducted as explained below.

Figure 10:
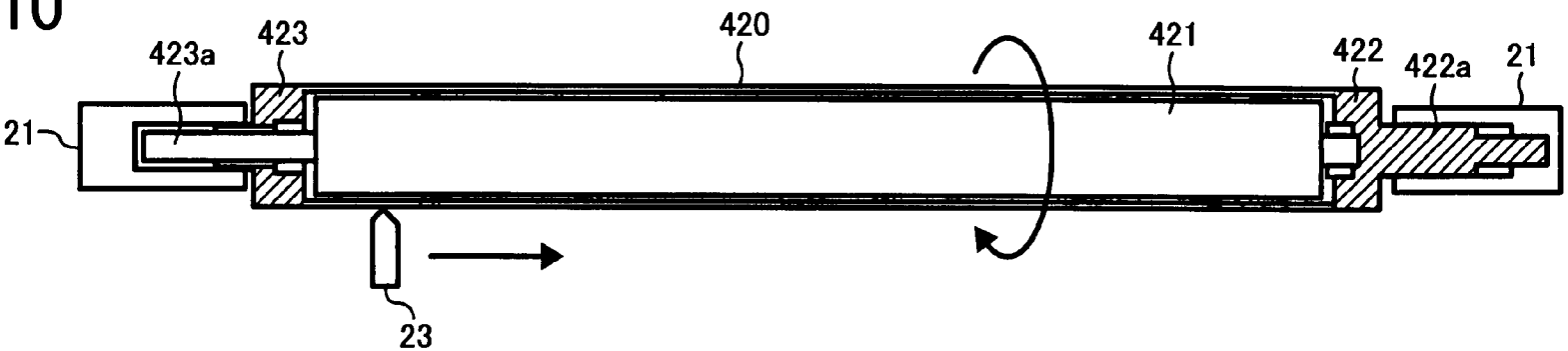
FIG. 10 shows a schematic process for explaining another cutting work on a developing sleeve.

For example, as shown in FIG. 10, after inserting the magnet roller 421 in the developing sleeve 420 and fixing the flanges 422 and 423 at each end of the developing sleeve 420, a cutting process can be conducted on the developing sleeve 420.

In this case, the boss portion 423*a* of the flange 423 and a boss portion 422*a* of the flange 422 are held by the holding device 21 of a cutting machine as shown in FIG. 10. By rotating the holding device 21, the developing sleeve 420 can be rotated.

The cutting tool 23 is, slidably moved on the developing sleeve 420 in an axial direction of the developing sleeve 420 until a vibration of the developing sleeve 420 reaches a predetermined level.

In an exemplary embodiment, the vibration of the developing sleeve 420 is set to 20 μm of less, for example.

Figure 11A:
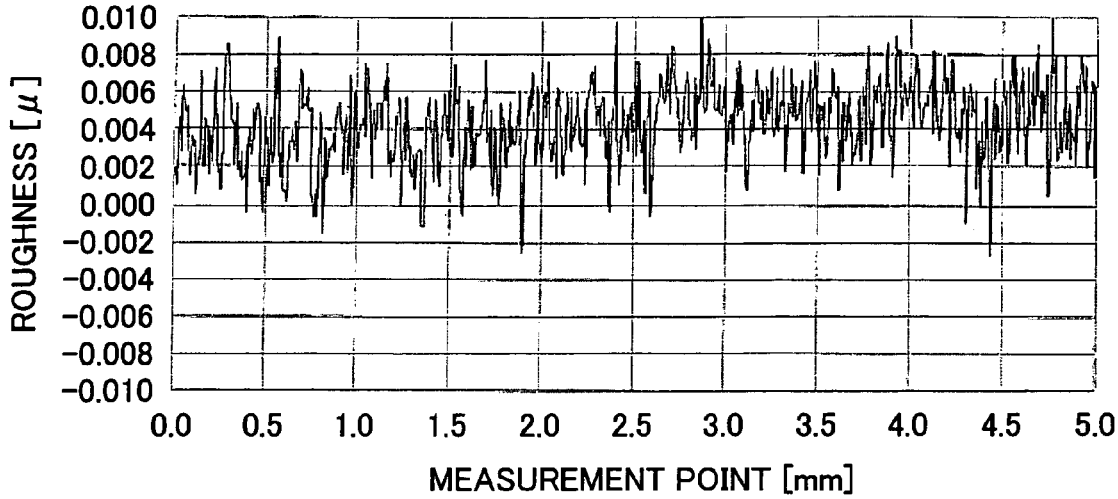
FIG. 11A is a schematic roughness profile of a developing sleeve surface, which receives a conventional sandblasting.
Figure 11B:
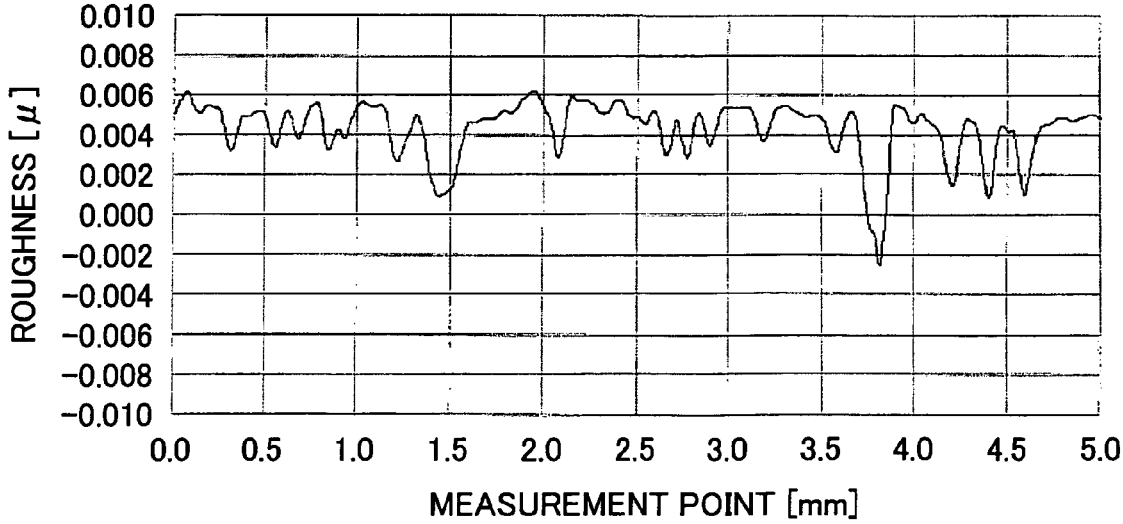
FIG. 11B is a schematic roughness profile of a developing sleeve surface, which receives a blasting according to an example embodiment.

FIG. 11A is a schematic roughness profile of a developing sleeve surface, which receives a conventional sandblasting, and FIG. 11B is a schematic roughness profile of a developing sleeve surface, which receives a blasting according to an example embodiment.

The roughness profile of the developing sleeve 420 is measured under the following conditions: a measurement device is a laser displacement sensor having a spot diameter of 10 pm or less; a scanning length (i.e., measurement-range length LL) on the developing sleeve 420 is set to 5 mm; and a measurement pitch is set to approximately 6 μm.

As can be seen in FIGS. 11A and 11B, the roughness profile of the developing sleeve 420 according to an example embodiment has a relatively smaller number of mountains and valleys compared to the roughness profile of the conventional developing sleeve, whereby the developing sleeve 420 according to an example embodiment has a relatively mild roughness surface compared to a conventional developing sleeve.

FIG. 12A is a schematic view explaining a carrier transport condition on a developing sleeve 420 treated by a conventional sandblasting, and FIG. 12B is a schematic view explaining a carrier transport condition on a developing sleeve 420 treated by a blasting according to an example embodiment.

As shown in FIG. 12A, a carrier C can be carried by a mountain peak on a conventional developing sleeve to transport the carrier C to a developing area.

As shown in FIG. 12A, the mountain peak has an acute-angled shape, whereby the mountain peak may likely change its shape when the developing sleeve is abraded during a use of developing sleeve over the time. If the mountain peak may lose its acute-angled shape, the carrier C is less likely to be carried by the mountain peak on the developing sleeve.

In such a case, developer transportability on the developing sleeve degrades over the time, and such degradation may cause degradation of the image quality such as patchy image over the time.

On one hand, as shown in FIG. 12, the developing sleeve 420 according to an example embodiment, the carrier C can be carried in a concave portion formed between mountain peaks, and be transported to a developing area with a rotation of the developing sleeve 420.

As for the developing sleeve 420 according to an example embodiment, the concave portion which can carry and transport the carrier C may be less likely to change its shape during a use of the developing sleeve 420 over the time.

Therefore, degradation of developer transportability on the developing sleeve 420 according to an example embodiment can be suppressed compared to -a conventional developing sleeve, which can carry the carrier C by the mountain peak on the developing sleeve.

Therefore, an image quality produced by the developing sleeve 420 according to an example embodiment can be maintained at a favorable level over the time.

Furthermore, because a conventional developing sleeve carries and transports the carrier C by acute-angled convex portions, external additives and toner T on the carrier C may be dropped from the carrier C with an effect of abrasion of the carrier C at acute-angled convex portions, and such dropped external additives and toner T may be fixed in tiny concave portions on the developing sleeve as shown in FIG. 12A.

Such external additives and toner T adhered in the tiny concave portion may change the electrical resistance of the developing sleeve, by which a developing bias voltage may deviate from a predetermined value. In such a case, degradation of developing capability of the developing sleeve may happen.

On the one hand, as for the developing sleeve 420 according to an example embodiment, the carrier C can be carried and transported by the concave portion, whereby external additives and toner T on the carrier C are less likely to drop from the carrier C.

Furthermore, as shown in FIG. 12B, a number of the tiny concave portions on the developing sleeve 420 may be smaller as compared to the conventional developing sleeve, whereby adhesion of the external additives and toner T in the tiny concave portions on the developing sleeve 420 may be suppressed.

Therefore, the developing sleeve 420 according to an example embodiment can favorably maintain its developing capability over the time.

Furthermore, as shown in FIG, 12A, because the conventional developing sleeve carries and transports the carrier C to an developing area by the acute-angled mountain peaks, external additives on the carrier C may be scraped by such mountain peaks, which may result into degradation of the carrier C.

On one hand, the developing sleeve 420 according to an example embodiment has relatively mild roughness on its surface, whereby scraping of the external additives by mountain peaks may be suppressed.

Therefore, the developing sleeve 420 according to an example embodiment can suppress degradation of the carrier C as compared with the conventional developing sleeve.

Hereinafter, a two-component developer used in an example embodiment is explained.

As for a carrier of a two-component developer, the carrier includes a core material and a surface layer. The surface layer preferably has a good elasticity and adhesiveness, and preferably includes particles having a diameter, which is larger than a thickness of the surface layer.

FIG. 13 is a schematic sectional view of a carrier 500. The carrier 500 includes a ferrite 501 as core material, for example.

As shown in FIG. 13, the ferrite 501 is coated by a coating layer 502. The coating layer 502 includes a resinous portion and a charge-adjusting agent, for example.

The resinous portion can be made from a cross linking reaction of a melamine resin and a thermoplastic resin such as acrylic resin, for example. Such coating layer 502 has preferable elasticity and adhesiveness features.

Furthermore, as shown in FIG. 13, particles 503 having a diameter, which is larger than a thickness of the surface of the coating layer 502, can be dispersed in the coating layer 502. The particles 503 include alumina particles, for example. The particles 503 are held by the coating layer 502 with adhesiveness of the coating layer 502.

A conventional carrier includes a relatively hard surface layer to prolong a lifetime of the carrier. Specifically, such relatively hard surface layer prolongs the lifetime of the surface layer because such relatively hard surface layer is scraped gradually over the time.

On the one hand, the carrier 500 shown in FIG. 13 suppresses degradation of the coat layer 502 such as scraping of the coating layer by absorbing shock with an elasticity effect of the coating layer 502.

Furthermore, by dispersing the particles 503 having a diameter larger than the thickness of the coating layer 502 on the surface of the carrier 501, the coating layer 502 may be prevented from being subjected to a direct external shock.

Furthermore, such carrier 500 can prevent an unfavorable accumulation and adhesion of particles such as toner and additives on the surface of the carrier 500.

As above-described, the carrier 500 can suppress degradation of the coating layer 502 and suppress the unfavorable accumulation and adhesion of particles such as toner and additives on the surface of the carrier 500.

Accordingly, the carrier 500 can prolong its lifetime compared to a conventional carrier.

With employment of the carrier 500, an amount of developer carried and transported on the developing sleeve can be maintained at a preferable level over the time. As a result, the quality of image to be produced on a recording sheet can be maintained at a preferable level over the time.

Furthermore, the particle diameter of the carrier 500 can be made smaller to produce an image with a higher quality having higher granularity on a recording sheet.

Specifically, the particle diameter of the carrier 500 is preferably set to from 20 μm to 50 μm in an exemplary embodiment.

By setting the particle diameter of the carrier 500 in such range, which is smaller than a conventional carrier, the thickness of carrier-chain formed onto the developing sleeve can be made relatively smaller and variations of the thickness of each carrier-chain can be made smaller. With such carrier-chain, toners can be supplied onto the developing sleeve more precisely.

Furthermore, in such a case, the density of the carrier-chain per unit area on the developing sleeve reaches a relatively larger level, whereby a larger number of toners can be supplied to an electrostatic latent image formed on a Photoconductive member. Therefore, an image can be produced on a recording sheet with a higher image quality having higher granularity.

If the particle diameter of the carrier becomes too large, a surface area of the carrier becomes smaller. The smaller the surface area of the carrier, the smaller the toner amount carried by the carrier becomes. In such a case, degradation may happen to the toner concentration on a developing sleeve. Increasing the amount of the developer transported on a developing sleeve may compensate for such drawback. However, such increase in the amount of the developer may more likely cause toner adhesion on the developing sleeve.

If the particle diameter of the carrier becomes too small, a magnet roller may not hold the carrier effectively because a smaller carrier particle may not be effectively attracted by a magnetic power of the magnet roller. In such a case, the carrier may scatter and the adhesion of carriers on a photoconductive member may more likely to happen.

In an exemplary embodiment, the particle diameter of the carrier 500 is preferably set to from 20 μm to 50 μm as above mentioned.

Hereinafter, Examples according to an exemplary embodiment and Comparative Examples are explained.

EXAMPLE 1

Example 1 is for a developing roller, in which a developing sleeve surface was treated by a SUS cut-wire for roughness treatment. The developing sleeve surface had a maximum roughness Rmax of 5.81 μm, a surface index of 2.79, and an average interval Sm of 100.

EXAMPLE 2

Example 2 is for a developing roller, in which a developing sleeve surface was treated by SUS cut-wire for roughness treatment as similar to Example 1. The developing sleeve surface had a maximum roughness Rmax of 9.34 μm, a surface index of 1.74, and an average interval Sm of 120.

EXAMPLE 3

Example 3 is for a developing roller, in which a developing roller includes a developing sleeve having grooves thereon. Furthermore, the surface of the developing sleeve was treated by SUS cut-wire for roughness treatment. The developing sleeve surface had a maximum roughness Rmax of 9.34 μm, a surface index of 1.74, and an average interval Sm of 120.

EXAMPLE 4

Example 4 is for a developing roller, in which a developing roller includes a developing sleeve having grooves thereon, and the surface of the developing sleeve was treated by SUS cut-wire for roughness treatment as similar to Example 3. The developing sleeve surface had a maximum roughness Rmax of 9.3 μm, a surface index of 2.98, and an average interval Sm of 130.

Comparative Example 1

Comparative Example 1 is for a developing roller, in which a developing sleeve surface was treated by sandblasting for roughness treatment. The developing sleeve surface had a maximum roughness Rmax of 13.5 μm, a surface index of 0.057, and an average interval Sm of 45.

Comparative Example 2

Comparative Example 2 is for a developing roller, in which a developing sleeve surface was treated by sandblasting for roughness treatment as similar to Comparative Example 1. The developing sleeve surface had a maximum roughness Rmax of 10.8 μm, a surface index of 0.078, and an average interval Sm of 40.

Comparative Example 3

Comparative Example 3 is for a developing roller, in which grooves were formed on a developing sleeve. Furthermore, the developing sleeve surface was formed into a smooth surface.

Each of the developing rollers for the Examples and Comparative Examples was installed in an image forming apparatus operated in a same condition.

Each of the Examples and Comparative Examples were evaluated in terms of the amount of developer transported on the developing sleeve and an image quality on a recording sheet at following stages; 1) when the image forming apparatus is started (initial stage in FIG. 14); 2) when the image forming apparatus conducted 50,000 times instances of image forming (after 50,000 stage in FIG. 14); 3) when the image forming apparatus conducted 100,000 instances of image forming (after 100,000 stage in FIG. 14); and 4) when the image forming apparatus conducted 100,000 image forming operations and the developer was replaced (after 100,000+replacement stage in FIG. 14).

The carrier having a particle diameter of 35 μm was used for the Examples and Comparative Examples.

FIG. 14 shows the results of Examples and Comparative Examples.

In FIG. 14, Examples 1 to 4 are abbreviated as Ex. 1 to Ex. 4 and Comparative Examples 1 to 3 are abbreviated as Comp. Ex. 1 to Comp. Ex. 3.

In FIG. 14, the result of the amount of developer transported on the developing sleeve was described in "TA (transport amount)" column, which was measured with a unit of "mg/cm$^2$".

In FIG. 14, the result of the image quality was described in "IQ (image quality)" column. The image quality on a recording sheet was evaluated in following grades; A) excellent level; B) normal (allowable) level; C) minimum allowable level; and 17) not-allowable level. In addition, "patchy" means an image having at least one faint portion in image, "image unevenness" means an image having unevenness in terms of image concentration.

The developing sleeve of Comparative Example 3 having grooves was not treated with roughness process, and dimensions of such grooves had variation each other. Accordingly, the amount of the developer transported on the developing sleeve varied for each groove, and image unevenness happened on a recording sheet from the start of image forming operation.

Compared to the developing rollers of Examples 1 to 4, the developing rollers of Comparative Examples 1 and 2 show results that degradation happened to the amount of the developer transported on the developing sleeve over the time and to an image quality (e.g., patchy image).

Furthermore, compared to the developing rollers of Examples 1 to 4, the developing rollers of Comparative Examples 1 and 2 show results indicating that degradation occurred with respect to the amount of the developer transported on the developing sleeve after conducting 100,000 image forming operations and subsequent replacement of the developer.

As above-described, Comparative Examples 1 and 2 conducted transportation of the developer on the developing sleeve by carrying carriers with acute-angled mountain peaks. Therefore, when the mountain peak was abraded over the time, carriers may not be effectively carried by mountain peaks, and degradation may occur with respect to the amount of the developer transported on the developing sleeve. In such a case, image quality degradation such as patchy images may happen.

On one hand, the developing rollers of Examples 1 to 4 show results that degradation of the amount of the developer transported on the developing sleeve was suppressed over the time, and an image quality was maintained at a preferable level over the time.

Furthermore, as compared to the developing roller of Example 1 having a maximum roughness Rmax of 5.81 (about one-sixth of 35 μm (i.e., the particle diameter of the carrier)), the developing rollers of Examples 2 to 4 having a maximum roughness Rmax of 9.3 or greater (i.e., greater than one-fourth of 35 μm (i.e., the particle diameter of the carrier)) had less degradation as compared to the amount of the developer transported on the developing sleeve over the time. This can be explained as below. Compared to the developing roller of Example 1, the developing rollers of Examples 2 to 4 had relatively deep concave portions for transporting carriers, whereby the developing rollers of Examples 2 to 4 can transport carriers more effectively than the developing roller of Example 1.

Furthermore, as compared to the developing rollers of Examples 1 and 2 only treated with roughness treatment, the developing rollers of Examples 3 and 4 had a relatively larger amount of the developer transported on the developing sleeve after conducting 100,000 image forming operations.

If the developer degrades and lose its flexibility, the developer may accumulate around a doctor blade. In such a case, an amount of developer that can pass through a gap at the doctor blade may become smaller. In such a case, the amount of the developer transported on the developing sleeve may decrease.

The developing rollers of Examples 3 and 4 had deeply concaved grooves from the developing sleeve surface, and carriers can be transported by such deeply concaved grooves, whereby the developing rollers of Examples 3 and 4 can stably transport the developer over the time compared to the developing rollers of Examples 1 and 2 having no such grooves.

Therefore, as compared to the developing rollers of Examples 1 and 2, the developing rollers of Examples 3 and 4 had a larger amount of the developer transported on the developing sleeve after conducting 100,000 times of image forming operations.

Accordingly, the developing rollers of Examples 3 and 4 can produce an image having a higher quality over the time compared to the developing rollers of Examples 1 and 2.

As above described, the developing sleeve (i.e., developer-carrying member) according to an exemplary embodiment, the surface index defined by the equation 1 can be used to judge the surface condition of the developing sleeve having concave and convex portions thereon.

As compared with such conventional method using the average interval Sm to judge a surface condition of the developing sleeve having concave-and convex portions, the surface index defined by the equation 1 can provide an improved judgment on a density of concave-and convex portions formed on the surface of the When the surface index is set to 1.5 or greater and the maximum roughness Rmax is set to one-sixth or greater of a carrier particle diameter, the carrier can be preferably carried and transported by the concave portion on the developing sleeve to a developing area.

Furthermore, when the surface index is set to 1.5 or greater and the maximum roughness Rmax is set to one-sixth or greater of a carrier particle diameter, convex portions on the developing sleeve can be formed so as to have a mild roughness. In such a case, scraping toners and external additives from the carrier by the convex portion can be suppressed.

With such configuration, the electric resistance of the developing sleeve can be stabilized over the time, whereby the developing sleeve can favorably maintain its developing capability over the time.

Furthermore, as for the developing sleeve (i.e., developer-carrying member) according to an example embodiment, a plurality of grooves are formed on the developing sleeve surface, wherein the grooves extend in an axial direction of the developing sleeve.

If the developer degrades and lose its flexibility, the doctor blade may cut the carrier-chain, by which the developer may accumulates around the doctor blade.

The accumulated developer may block a gap between the doctor blade and the developing sleeve, and the amount of developer, which pass through the doctor blade, may become smaller.

However, as for the developing sleeve (i.e., developer-carrying member) according to an example embodiment, even if the gap between the doctor blade and the developing sleeve is blocked by the degraded developer, the developer carried in the concaved grooves can be transported to a developing area because the grooves formed on the developing sleeve surface are deeply concaved from the developing sleeve surface.

Therefore, degradation of the developer transportability on the developing sleeve according to an exemplary embodiment can be suppressed compared to the developing sleeve having no grooves on its surface.

Furthermore, as for the developing sleeve (i.e., developer-carrying member) according to an exemplary embodiment, a groove depth is set larger than an average weight diameter of a magnetic carrier.

With such configuration, even if the gap between the doctor blade and the developing sleeve is blocked by degraded developer, the carrier carried in the grooves can be transported to the developing area.

Furthermore, as for the developing sleeve (i.e., developer-carrying member) according to an example embodiment, the developing sleeve is made of an aluminum or aluminum alloy, thereby the developing sleeve can be manufactured more precisely with a cost-wise manner.

Furthermore, the developing sleeve surface having grooves receives a cutting or grinding process.

If the grooves are formed on the developing sleeve surface after conducting a cutting or grinding process on the developing sleeve surface, the vibration characteristic of the developing sleeve may degrade because a stress applied to the developing sleeve when forming grooves may deform the developing sleeve.

In an example embodiment, the cutting or grinding process is conducted on the developing sleeve after forming grooves, thereby the developing sleeve can have a better vibration characteristic. Therefore, image degradation caused by a variation of the developing gap can be suppressed.

Furthermore, the edge portion of the groove can be shaped so as to have an "R-shape" because the roughness treatment is conducted after forming grooves on the developing sleeve.

If the roughness treatment is conducted before forming grooves on the developing sleeve, the edge portion of the groove cannot be shaped with an "R-shape." Such edge portion of the developing sleeve having no "R-shape" may be abraded over the time, and the edge portion change its shape to "R-shape" over the time. If the shape of the edge portion changes over the time, the developer transportability on the developing sleeve may deviate from a predetermined level.

On one hand, if the roughness treatment is conducted after forming grooves on the developing sleeve as in an example embodiment, the edge portion of the groove can be shaped with an "R-shape." In such a case, the shape of the edge portion can be maintained with a substantially "R-shape" over the time even if the edge portion is abraded over the time.

Therefore, a variation of the developer transportability of the developer on the developing sleeve according to an example embodiment can be suppressed over the time.

Furthermore, a developing unit according to an example embodiment can include the above-described developing sleeve (i.e., developing carrying member). By employing the above-described developing sleeve (i.e., developing carrying member), the developing unit can maintain, a stable transportation of the developer over the time.

Furthermore, as for the developing unit according to an example embodiment, the developer includes a two-component developer having toners and magnetic carriers, and the magnetic carriers have a particle diameter of from 20 μm to 50 μm, for example.

By setting the particle diameter of the carrier 500 in such range, the thickness of carrier-chain formed onto the developing sleeve can be made relatively smaller and variations of the thickness of each carrier-chain can be made smaller. With such carrier-chain, toners can be supplied onto the developing sleeve more precisely.

Furthermore, the density of the carrier-chain per unit area on, the developing sleeve can reach a relatively larger level, whereby a larger number of toners can be supplied to an electrostatic latent image formed on a photoconductive member. Therefore, an image can be produced on a recording sheet with a higher image quality having higher granularity.

If the particle diameter of the carrier becomes too small, a magnet roller may not hold the carrier effectively because a smaller carrier particle may not be effectively attracted by a magnetic power of the magnet roller. In such a case, the carriers may scatter and an adhesion of carriers on a photoconductive member may more likely to happen.

In an example embodiment, the particle diameter of the carrier 500 is preferably set to from 20 μm to 50 μm as above mentioned.

Furthermore, as for the developing unit according to an example embodiment, the magnetic carrier includes a magnetic core material and a coating layer made of resinous material, wherein such coating layer includes a resinous portion and a charge-adjusting agent. The resinous portion can be made from a cross-linking reaction of a melamine resin and a thermoplastic resin such as acrylic resin, for example.

A conventional carrier includes a relatively hard surface layer to prolong a lifetime of the carrier. Specifically, such relatively hard surface layer prolongs the lifetime of the surface layer because such relatively hard surface layer is scraped gradually over the time.

On one hand, the carrier according to an example embodiment suppresses degradation of the coat layer such as scraping of the coating layer by absorbing shock with an effect of elasticity of the coating layer.

With employment of such carrier 500, an amount of developer carried and transported on the developing sleeve can be maintained at a preferable level over the time. As a result, a quality of image to be produced on a recording sheet can be maintained at a preferable level over the time.

Furthermore, as for the image forming apparatus according to an example embodiment, the photosensitive members 2Y, 2M, 2C, and 2K (i.e., image carrying member) form electrostatic latent images thereon, and the developing unit develops the electrostatic latent images as toner images with toners in the developer. Then the toner images are transferred and fixed on a recording sheet.

Such image forming apparatus according to an example embodiment can employ the above-described developing unit, by which the image forming apparatus can produce an image having a higher quality (e.g., less image concentration unevenness) on a recording sheet.

Furthermore, as for the process cartridge of the image forming apparatus according to an example embodiment, the photosensitive member 2Y, 2M, 2C, and 2K form electrostatic latent images thereon, and the developing unit develops the electrostatic latent images as toner images with toners in the developer. Then, the toner images are transferred and fixed on a recording sheet. After transferring the toner images, toners remaining on the photoconductive member are cleaned.

Such process cartridge is detachable from the image forming apparatus, and integrally includes at least a developing unit according to an exemplary embodiment and a photosensitive member therein, and further includes other parts, as required.

With such process cartridge, the image forming apparatus can produce an image having a higher quality (e.g., less image concentration unevenness) on a recording sheet.

Furthermore, a maintenance and replacement work of the image forming apparatus can be conducted more easily by employing such process cartridge, which integrates at least a developing unit and a photosensitive member.

Numerous additional modifications and variations are possible in light of the above teachings. It is therefore to be understood that within the scope of the appended claims, the disclosure of the present invention may be practiced otherwise than as specifically described herein.

This application claims priority from Japanese patent applications No. 2005-036534 filed on Feb. 14, 2005, and No. 2006-003996 filed on Jan. 11, 2006 in the Japan Patent Office, the entire contents of which are herein incorporated by reference.

What is claimed is:

1. A developer-carrying member to transport a developer having a carrier to a developing area facing an image carrying member in an image forming apparatus, the developer-carrying member comprising:

a sleeve configured to carry the developer on a surface of the sleeve;

wherein the surface of the sleeve is formed with a plurality of grooves extending in an axial direction of the sleeve, and wherein the surface of the sleeve receives a surface treatment to make concave and convex portions thereon, and wherein the surface treatment forms a shape of a plurality of concave and convex shaped portions which prevents abrasion of the carrier on the surface of the sleeve;

wherein the surface of the sleeve has a maximum roughness Rmax of one-sixth or greater than a particle diameter of the carrier, and a surface index of 1.5 or greater, wherein the surface index is expressed by an equation of $$\text{surface index} = Rmax/(L_{total}-LL),$$

wherein LL is a measurement range length selected from a roughness profile of the surface of the sleeve, $L_{total}$ is a total surface distance of the developer-carrying member in the measurement-range length LL, and Rmax is a maximum roughness of the sleeve surface, and wherein Rmax is defined by a difference between a maximum roughness value and a minimum roughness value on a roughness profile of the surface of the sleeve.

2. The developer-carrying member according to claim 1, wherein the sleeve includes aluminum and aluminum alloy.

3. The developer-carrying member according to claim 1, wherein the developer includes a two-component developer having the carrier and a toner, wherein the carrier includes a magnetic carrier.

4. The developer-carrying member according to claim 3, wherein the magnetic carrier has a particle diameter of 20 μm to 50 μm.

5. The developer-carrying member according to claim 3, wherein the magnetic carrier includes a magnetic core material and a coat layer which coats the magnetic core material, wherein the coat layer includes a resinous portion made from a cross-linking of a thermoplastic resin and a melamine resin, and a charge-adjusting agent.

6. The developer-carrying member according to claim 5, wherein the magnetic carrier further includes particles made of aluminum in the coat layer, and wherein the particles made of aluminum have a particle diameter greater than a thickness of the coat layer.

7. The developer-carrying member according to claim 1, wherein the plurality of grooves have a depth which is greater than an average weight diameter of the carrier.

8. The developer-carrying member according to claim 1, wherein the surface of the sleeve receives a roughness treatment thereon after forming the plurality of grooves and subsequently conducting any one of a cutting and grinding process on the sleeve.

9. A developing unit for use in an image forming apparatus to develop an electrostatic latent image formed on an image carrying member, the developing unit, comprising:

a developer container configured to contain a developer having a carrier; and a developer-carrying member configured to transport the developer to a developing area facing the image carrying member, the developer-carrying member, comprising;

a sleeve configured to carry the developer on a surface of the sleeve, wherein the surface of the sleeve has a maximum roughness Rmax of one-sixth or greater than a particle diameter of the carrier, and a surface index of 1.5 or greater, wherein the surface index is expressed by an equation of $$\text{surface index} = Rmax/(L_{total}-LL)$$

wherein LL is a measurement-range length selected from a roughness profile of the surface of the sleeve, $L_{total}$ is a total surface distance of the developer-carrying member in the measurement-range length LL, and Rmax is a maximum roughness of the sleeve surface, and wherein Rmax is defined by a difference between a maximum roughness value and a minimum roughness value on a roughness profile of the surface of the sleeve.

10. The developing unit according to claim 9, wherein the sleeve includes aluminum and aluminum alloy.

11. The developing unit according to claim 9, wherein the developer includes a two-component developer having the carrier and a toner, and wherein the carrier includes a magnetic carrier.

12. The developing unit according to claim 11, wherein the magnetic carrier has a particle diameter of 20 μm to 50 μm.

13. The developing unit according to claim 11, wherein the magnetic carrier includes a magnetic core material and a coat layer which coats the magnetic core material, wherein the coat layer includes a resinous portion made from a cross-linking of a thermoplastic resin and a melamine resin, and a charge-adjusting agent.

14. The developer-carrying member according to claim 13, wherein the magnetic carrier further includes particles made of aluminum in the coat layer, and wherein the particles made of aluminum have a particle diameter greater than a thickness of the coat layer.

15. The developing unit according to claim 9, wherein the surface of the sleeve is formed with a plurality of grooves extending in an axial direction of the sleeve.

16. The developing unit according to claim 15, wherein the plurality of grooves have a depth which is greater than an average weight diameter of the carrier.

17. The developing unit according to claim 15, wherein the surface of the sleeve receives a roughness treatment thereon after forming the plurality of grooves and subsequently conducting any one of a cutting and grinding process on the sleeve.

18. An image forming apparatus, comprising:

a charging unit;

an image carrying member configured to be charged by the charging unit, and configured to form an electrostatic latent image thereon;

a developing unit configured to develop the electrostatic latent image formed on the image carrying member with a developer, the developing unit, comprising:

a developer container configured to contain the developer having a carrier and a toner; and a developer-carrying member configured to transport the developer to a developing area facing the image carrying member, the developer-carrying member, comprising:

a sleeve configured to carry the developer on a surface of the sleeve, wherein the surface of the sleeve has a maximum roughness Rmax of one-sixth or greater than a particle diameter of the carrier, and a surface index of 1.5 or greater, wherein the surface index is expressed by an equation of $$\text{surface index}=Rmax/(L_{total}-LL)$$

wherein LL is a measurement-range length selected from a roughness profile of the surface of the sleeve, $L_{total}$ is a total surface distance of the developer-carrying member in the measurement-range length LL, and Rmax is a maximum roughness of the sleeve surface, wherein Rmax is defined by a difference between a maximum roughness value and a minimum roughness value on a roughness profile of the surface of the sleeve; and a cleaning unit configured to remove the toner remaining on the image carrying member after transferring an image to a transfer member.

19. A process cartridge detachably provided in an image forming apparatus, comprising:

a charging unit;

an image carrying member configured to be charged by the charging unit, and configured to form an electrostatic latent image thereon;

a developing unit configured to develop the electrostatic latent image formed on the image carrying member with a developer, the developing unit, comprising:

a developer container configured to contain the developer having a carrier and a toner; and a developer-carrying member configured to transport the developer to a developing area facing the image carrying member, the developer-carrying member, comprising:

a sleeve configured to carry the developer on a surface of the sleeve wherein the surface of the sleeve has a maximum roughness Rmax of one-sixth or greater than a particle diameter of the carrier, and a surface index of 1.5 or greater, wherein the surface index is expressed by an equation of $$\text{surface index}=Rmax/(L_{total}-LL)$$

wherein LL is a measurement-range length selected from a roughness profile of the surface of the sleeve, $L_{total}$ is a total surface distance of the developer-carrying member in the measurement-range length LL, and Rmax is a maximum roughness of the sleeve surface, and wherein Rmax is defined by a difference between a maximum roughness value and a minimum roughness value on a roughness profile of the surface of the sleeve; and a cleaning unit configured to remove the toner remaining on the image carrying member after transferring an image to a transfer member.

20. A method of forming concave and convex portions on a surface of a sleeve of a developer-carrying member, comprising the steps of:

forming a plurality of grooves extending in an axial direction of the sleeve;

cutting the surface of the sleeve after forming the plurality of grooves; and processing the surface of the sleeve with a roughness treatment after cutting the surface of the sleeve such that the surface of the sleeve has a maximum roughness Rmax of one-sixth or greater than a particle diameter of the carrier, and a surface index of 1.5 or greater, wherein the surface index is expressed by an equation of $$\text{surface index}=Rmax/(L_{total}-LL),$$

wherein LL is a measurement range length selected from a roughness profile of the surface of the sleeve, $L_{total}$ is a total surface distance of the developer-carrying member in the measurement-range length LL, and Rmax is a maximum roughness of the sleeve surface, and wherein Rmax is defined by a difference between a maximum roughness value and a minimum roughness value on a roughness profile of the surface of the sleeve.

21. The method of according to claim 20, wherein the roughness treatment is conducted by impacting a plurality cut-wires made of metal onto the surface of the sleeve.

* * * * *